US008281733B2

(12) United States Patent
Kreshek

(10) Patent No.: US 8,281,733 B2
(45) Date of Patent: Oct. 9, 2012

(54) SELF ADHESIVE MEDICATION REMINDER DEVICE

(75) Inventor: Jeffrey Kreshek, Encino, CA (US)

(73) Assignee: Ace Ventures, Inc., Encino, CA (US)

( * ) Notice: Subject to any disclaimer, the term of this patent is extended or adjusted under 35 U.S.C. 154(b) by 497 days.

(21) Appl. No.: 12/538,529

(22) Filed: Aug. 10, 2009

(65) Prior Publication Data

US 2009/0293798 A1 Dec. 3, 2009

Related U.S. Application Data

(63) Continuation-in-part of application No. 12/196,645, filed on Aug. 22, 2008, now Pat. No. 7,658,162.

(60) Provisional application No. 61/021,116, filed on Jan. 15, 2008.

(51) Int. Cl.
*G09F 9/00* (2006.01)

(52) U.S. Cl. ..... 116/311; 116/308; 116/309; 206/534

(58) Field of Classification Search ..... 116/306, 116/308–309, 311–312, DIG. 3; 40/310–311, 40/113–115; 206/534
See application file for complete search history.

(56) References Cited

U.S. PATENT DOCUMENTS 566,297 A * 8/1896 Cooley ..... 116/309
623,171 A 4/1899 Mowry
727,645 A * 5/1903 Lea ..... 116/308
784,194 A * 3/1905 Victor ..... 215/230
1,211,737 A 1/1917 Martini
1,796,398 A 3/1931 Richardson
2,024,889 A * 12/1935 Simeone ..... 116/311
2,066,183 A 12/1936 Mchaffey
2,111,637 A * 3/1938 Mehaffey ..... 116/308
2,450,949 A 10/1948 Salvadore et al.
2,492,891 A * 12/1949 Schall ..... 40/307
2,565,095 A * 8/1951 Schatzkin ..... 116/308
2,587,147 A * 2/1952 Guion et al. ..... 116/308
2,707,932 A * 5/1955 Masciana ..... 116/324
2,713,845 A 7/1955 Silverman
2,774,158 A * 12/1956 Tamoschat ..... 40/307
2,817,451 A * 12/1957 Giles et al. ..... 215/230
3,437,236 A 4/1969 Huck
3,446,179 A 5/1969 Bender
3,533,371 A * 10/1970 Kutik et al. ..... 206/534
3,675,620 A 7/1972 Baustin
3,678,884 A * 7/1972 Robbins ..... 116/308
3,753,417 A * 8/1973 Garby ..... 116/308
3,921,568 A 11/1975 Fish
4,011,829 A * 3/1977 Wachsmann et al. ..... 116/308
4,148,273 A 4/1979 Hollingsworth
4,345,541 A 8/1982 Villa-Real
(Continued)

*Primary Examiner* — Peter Macchiarolo
*Assistant Examiner* — Tania Courson
(74) *Attorney, Agent, or Firm* — Berenato & White, LLC

(57) ABSTRACT

The present invention is a dosage reminder device that serves as a regular and constant reminder of when a medication was last taken as well as when a medicine should next be taken. The device is attached to any medicine box or bottle using a self-adhesive or strap style backing element and, owing to its relative simplicity and low cost, can be disposed of once the medication has been used or is no longer needed. The dial portion includes an opposed raised annular rim with radially inwardly oriented detents. By being mechanically engaged in multiple locations, the dial indicator resists movement, even with inadvertent patient dropping or scraping of the medication receptacle, thusly clearly and securely showing dosage timing.

14 Claims, 7 Drawing Sheets

U.S. PATENT DOCUMENTS

| | | | | | |
|---|---|---|---|---|---|
| 4,347,804 | A | | 9/1982 | Villa-Real | |
| 4,405,045 | A | | 9/1983 | Villa-Real | |
| 4,528,933 | A | * | 7/1985 | Allen | 116/308 |
| 4,666,051 | A | | 5/1987 | Trick | |
| 4,985,879 | A | * | 1/1991 | Owens | 368/89 |
| 5,152,422 | A | | 10/1992 | Springer | |
| 5,271,353 | A | * | 12/1993 | Besthorne | 116/308 |
| 5,279,422 | A | * | 1/1994 | Adams | 206/534 |
| 5,313,439 | A | | 5/1994 | Albeck | |
| 5,358,117 | A | | 10/1994 | Adams | |
| 5,377,614 | A | | 1/1995 | Glazer | |
| 5,778,818 | A | * | 7/1998 | Marshall | 116/313 |
| 6,152,067 | A | | 11/2000 | Mathison | |
| D461,139 | S | | 8/2002 | Hawley | |
| 6,561,124 | B1 | * | 5/2003 | Marczynski et al. | 116/309 |
| 7,017,513 | B2 | | 3/2006 | Giewercer | |
| 7,032,535 | B2 | | 4/2006 | Halstead et al. | |
| 7,100,530 | B2 | | 9/2006 | Lu | |
| 7,263,947 | B2 | | 9/2007 | Giewercer | |
| 7,314,022 | B2 | | 1/2008 | Sollaccio | |
| 7,568,481 | B2 | * | 8/2009 | Scarrott et al. | 128/205.23 |
| 7,665,611 | B2 | * | 2/2010 | Koch | 206/534 |
| 2005/0056203 | A1 | | 3/2005 | Giewercer | |
| 2006/0180566 | A1 | | 8/2006 | Mataya | |
| 2008/0000799 | A1 | | 1/2008 | Arvidsson et al. | |
| 2008/0308033 | A1 | | 12/2008 | Cirrincione | |

* cited by examiner

SELF ADHESIVE MEDICATION REMINDER DEVICE

This application is a Continuation-in-Part of application Ser. No. 12/196,645, filed Aug. 22, 2008, now U.S. Pat. No. 7,658,162, which application claims the benefit of U.S. provisional Application No. 61/021,116, filed Jan. 15, 2008.

BACKGROUND OF THE INVENTION

1. Field of the Invention

The invention relates generally to a self adhesive medication reminder device. More specifically, the invention relates to a self-adhesive medication reminder device using a time indicator dial re-settable by the user.

2. Background

Millions of people routinely take medications for a specific, short term illness, or over the counter medications for a specific ailment. In recent years, the incident of overdose has dramatically risen leaving the medical profession liable for damages as a result of such overdoses. With the medications needed at specific intervals, the need for a reminder of when a dosage was taken or next needs to be taken is critical. Other known devices such as U.S. PG Pub. No. 2006/0180566A1 and U.S. Pat. No. 4,405,045 are one dimensional in their approach with the only application being in conjunction with a vial provided by the pharmacy or other medical professional. Such known devices are typically bulky and overly complicated with a variety of date, day and time functions. The device(s) is more or less designed to be useful in the long term administration of medicine, as opposed to short term doses, and is not particularly adaptable to medications that come in boxes, tubes or oddly shaped bottles. Furthermore, these devices rely heavily on the long term calibration between the device and the prescription frequency on the label of the bottle itself. Other known devices attempt to provide the user with a similar result but require the wholesale transfer of the medication from the original container to a new reminder device.

U.S. Pat. Nos. 5,152,422 and 5,313,439 accomplish the goal of reminding the patient of the next interval for taking the prescribed medication while sacrificing valuable prescription medication information that is typically presented on the original bottle from the pharmacist. The prescription information or directions contained on the bottle or box is important to the patient to confirm or remind the patient of the proper interval. Should a patient transfer its medication to such a device, then dispose of the original container, and then potentially forget or miss-calibrate the device, the patient could be susceptible to an overdose. In addition, such devices potentially introduce the problem of not being able to later identify the medication as it is no longer clearly identified on the label. Thus, such devices are only valuable to long term patients or chronic patients who consistently take the same medication, at the same intervals over long periods of time. Such devices do not serve the non-chronic or temporary patients well. Additionally, such devices are not readily adaptable to medications that come in boxes or tubes or are purchased over the counter.

Other known devices such as U.S. Pat. No. 4,345,541 attempt to yield the same results but have the (potentially) fatal flaw of rotation to the outer ring of the device thus making the device highly susceptible to unwanted or undesired movement. With the ease of change to the timing devices, a user can never be completely sure that the interval shown on the dials has not inadvertently been moved or adjusted. Similarly, U.S. Pat. No. 5,377,614 introduces the potential for error in use of the two dials. Should the dials be reset accidentally, the user would be left without a clear indication of when the last dose was administered and when the next dose should be administered.

Therefore, there is found a need for a reliable, inexpensive and disposable reminder device to aid in reminding patient of the intervals at which they are due to ingest specific dosages of medicine.

SUMMARY OF THE INVENTION

The present advantageously fills the aforementioned deficiencies by providing a secure self attaching medication reminder device that results in a relatively fixed dial indicator system for indicating dosage timing. The invention is made up of the following elements: a self attaching backing, an (optional) advertising space, a main disk with individual time grooves representing the hours of a day/days of the week/medication cycle, and a central set of reminder hands that point toward and engage the individual time grooves.

Optional feature(s) would be the dedicated advertising space adjacent the reminder system. The device itself functions with or without the dedicated advertising space. The shape of the backing element can be altered to any shaped configuration and, although shown in rectangular form, could be any shape that could accommodate the surface dial and central pin configuration, and should also have sufficient flexibility to adapt to a container surface to which it is attached.

Finally, it is an object of the present invention to provide a self attaching medication reminder device that does not suffer from any of the problems or deficiencies associated with prior solutions.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
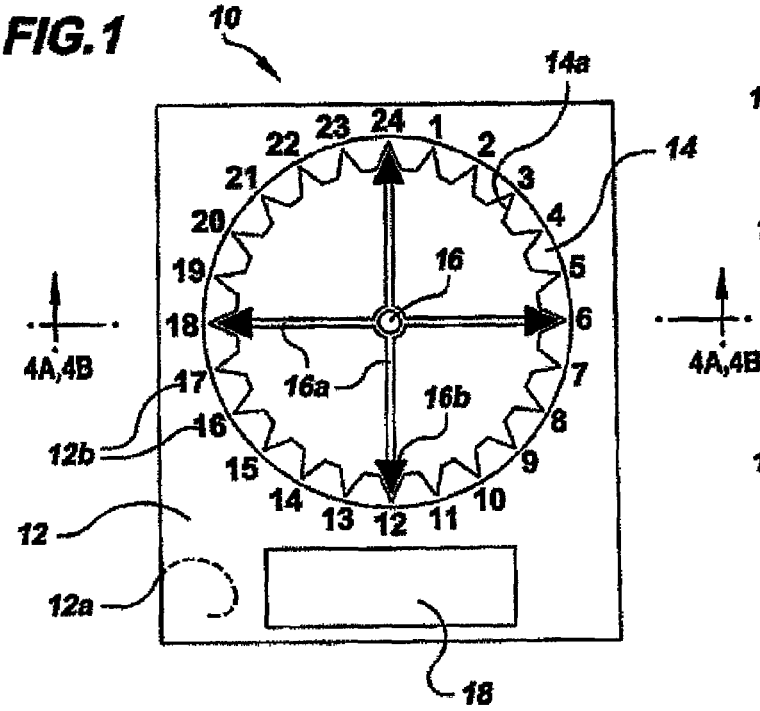
FIG. 1 is a top plan view of the invention 10.
Figure 2:
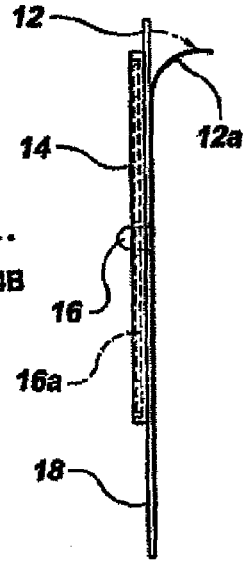
FIG. 2 is a side view of the invention 10.
Figure 3:
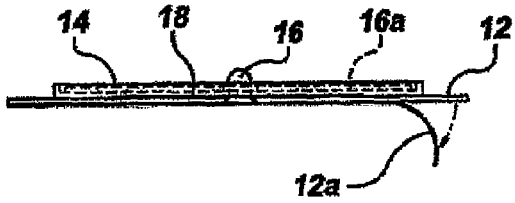
FIG. 3 is an end view of the invention 10.
Figure 4A:
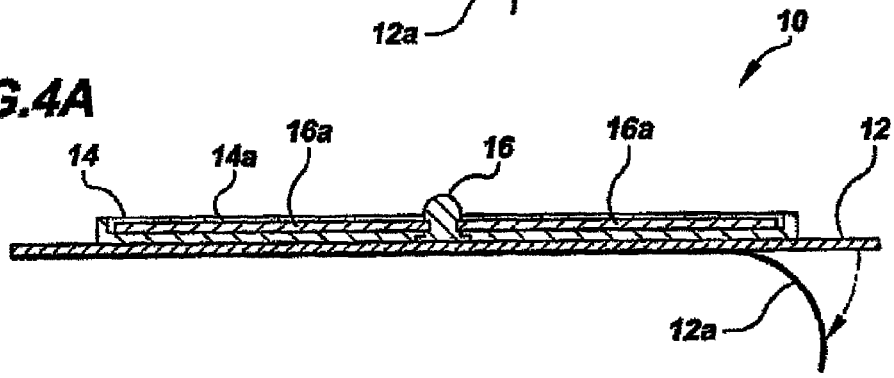
FIG. 4A is an enlarged cross section view of the invention shown in the set position and taken along lines 4A-4A of FIG. 1.
Figure 4B:
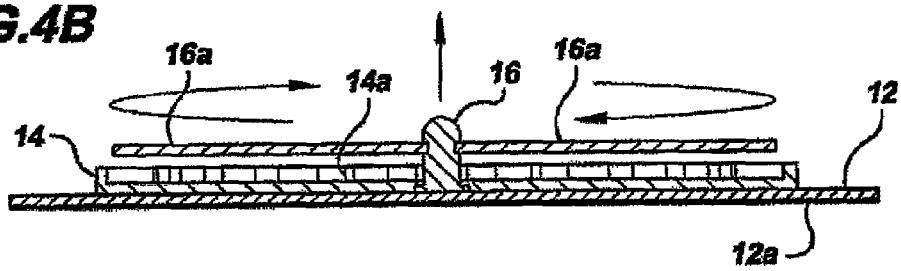
FIG. 4B is also an enlarged cross section view of the invention shown in the unset position and taken along lines 4B-4B of FIG. 1.
Figure 5:
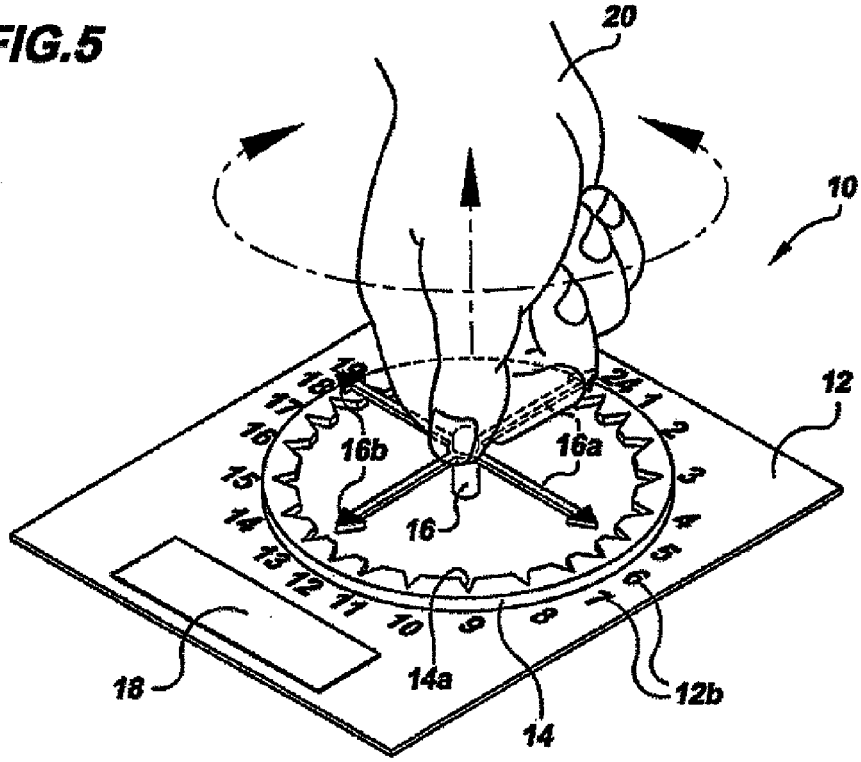
FIG. 5 is a perspective view of the invention 10 shown with the central pin 16 and reminder hands 16*a* raised away from the main disk 14 and time grooves 14*a* being adjusted to the proper position.
Figure 6:
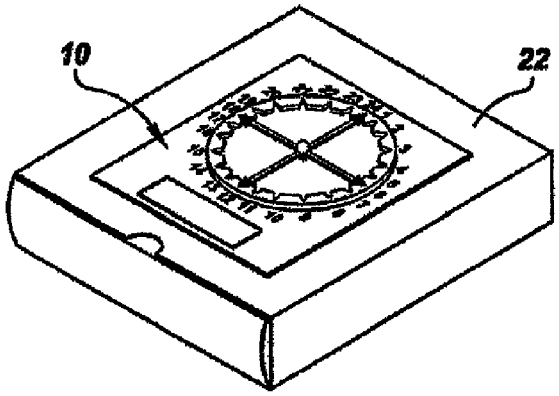
FIG. 6 is a perspective view of the invention 10 shown attached to a box 22 of medication.
Figure 7:
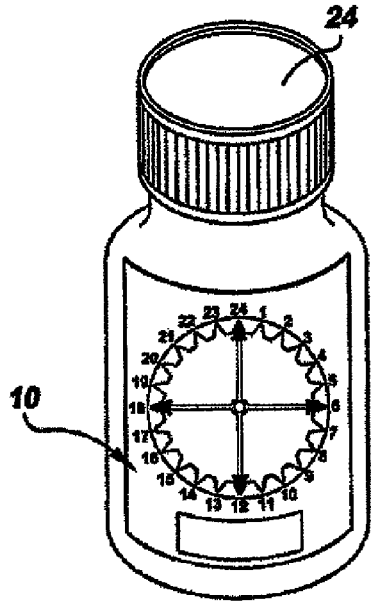
FIG. 7 is a perspective view of the invention 10 shown attached to a bottle 24 of medication.

With reference to the drawing FIGS. 1-7 et seq. The invention 10 provides the user with a simple way of keeping track of medication dosage times and also aids in remembering what time a specific dosage of medication was last taken. The device is not designed to actually administer a dosage or act as an electronic reminder. The invention 10 is designed to easily attach to a box 22 or bottle 24 of medication and specifically mark the hour of the dosage last administered and count out in set intervals of three, six, eight or twelve hours as to what time the next dosage should be administered. The self adhesive medication reminder device makes use of a self adhesive backing 12 of plastic, or paper, with plastic being the preferred material, with a plastic main disk 14 attached having twenty four individual grooves 14*a* which mark the twenty four hours of the day. The twenty-four individual grooves 14*a* are marked numerically with corresponding numbers printed 12*b* on the plastic or paper backing 12.

To use the device, the paper covering 12*a* on the back of the plastic backing 12 which protects the adhesive is removed and the device is placed on a box 22 or bottle 24 of medication. The device has a rubber central pin 16 in the middle of the main disk 14 which holds the reminder hands 16*a*. The reminder hands 16*a* have color coded arrow heads 16*b* which can be colored in one, two, three or four different colors and are used to clearly distinguish between the first dose and doses after. The color-coded arrow heads 16*b* of reminder arms 16*a* set within grooves 14*a* of main disk 14. The central pin 16 is pulled upward above the main disk 14 and turned to the desired hour and then lowered back down so color coded arrow heads 16*b* of reminder arms 16*a* set back within grooves/detents 14*a* of the main disk 14. The reminder hands 16*a* can have one, two, three, four, six or more arms depending on the medication dosage required.

The advertising space 18 is clearly marked on the self adhesive backing 12 using a material such as, but not limited to ink, paint or laser engraving. The adhesive backing can be produced using various materials such as, but not limited to, flexible or hard plastic, cloth or cardboard. One side of the self adhesive backing is covered with a commercial grade glue such as those found on band aids or stickers, and again covered with a peelable paper 12*a*, thus allowing the user to peel the paper off of the device and, using the glue side, attach the device to a box 22 or bottle 24. Flexible plastic is the preferred backing material. The main disk 14 can be produced using plastic or some other rigid material and the twenty-four hour individual time grooves 14*a* would be fashioned out of whatever material is used for the main disk. The central pin 16 can be made of various materials flexible enough to allow for easy movement of the reminder hands 16*a* and 16*b*. Materials such as rubber, string, or elastic are preferred. The key characteristic of this particular component is flexibility. The reminder dial can be produced out of materials such as plastic, wood, metal, or any other rigid material that will easily set into the twenty four hour grooves and withstand any external forces without easily breaking, bending to extremes, or moving. Shown here as a pin-wheel indicator with individual arms corresponding to hour intervals through a 24 hour period, the indicator 16 could also comprise a marked disc with detent/groove 14 engaging pointers 16*b* located thereon and extending therefrom radially outwardly.

While all components of the device could be manufactured using flexible plastic, wood, metal, hard plastic or cardboard, the preference is for all components to be manufactured using flexible plastic. The central pin 16 in particular should be made of a rubber band like material, with the key characteristic of elasticity and flexibility, making it easy for the pin to be pulled from the set position in order to move the reminder hands 16*a* to their proper position.

With reference to FIGS. 8-16 et seq: This embodiment of the invention 50 includes 5 basic elements: to wit: A front cover 52; a back cover 70; a flexible strap 60; a dial indicator 53; and a resilient element 80 contained between the respective covers that pushes the dial indicator outwardly with respect the front cover 52. The resilient element 80 maintains the dial indicator pointers 59 protrusions in registration with the medication timing indicia grooves 57. (The resilience function, per se, may be incorporated into the overall shape and form of the dial 53.)

Figure 8:
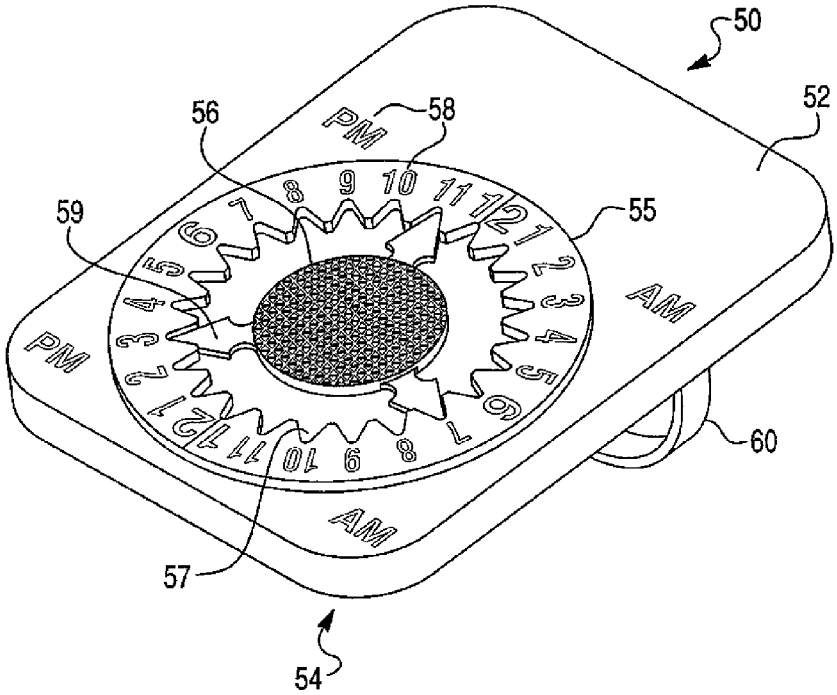
FIG. 8 is a perspective view of an alternative embodiment of the present invention.
Figure 9:
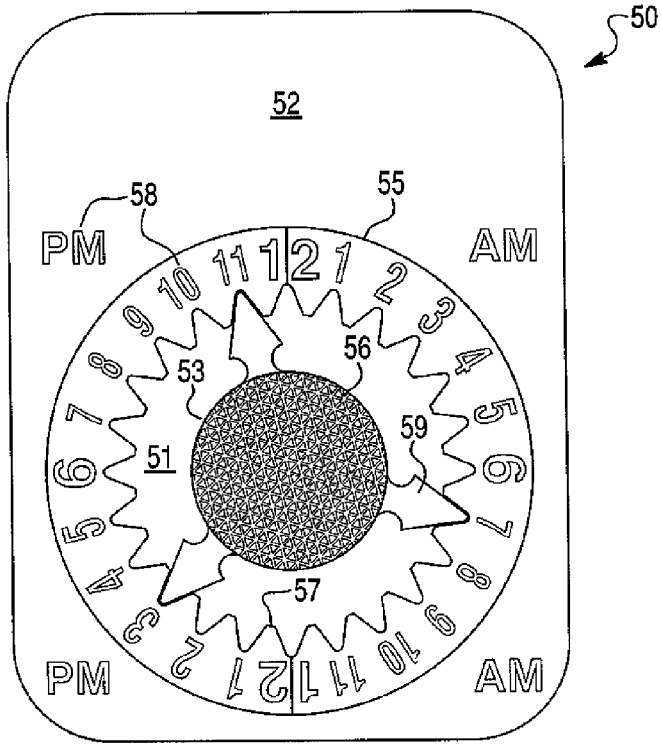
FIG. 9 is a front plan view of the embodiment of FIG. 8.
Figure 10:
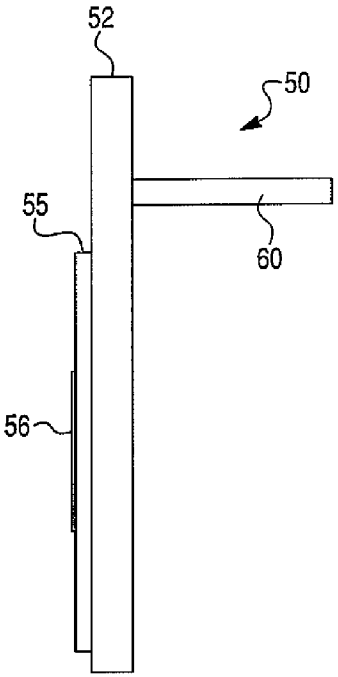
FIG. 10 is a side view of the embodiment of FIG. 8.

FIGS. 8, 9 and 10 depict perspective view, plan view, and side view, respectively, of the alternate embodiment 50. The front cover 52 includes a raised annular ring 55 that includes indicia 58 for medication timing thereon. The annular ring 55 includes an inner surface thereof that has inwardly directed grooves 57 for engaging extended elements of pointer protrusions 59 that form a part of the rotating dial 53. The flexible strap 60 secures the device 50 to a variety of differing medication containers (bottles, boxes, etc.).

Figure 11:
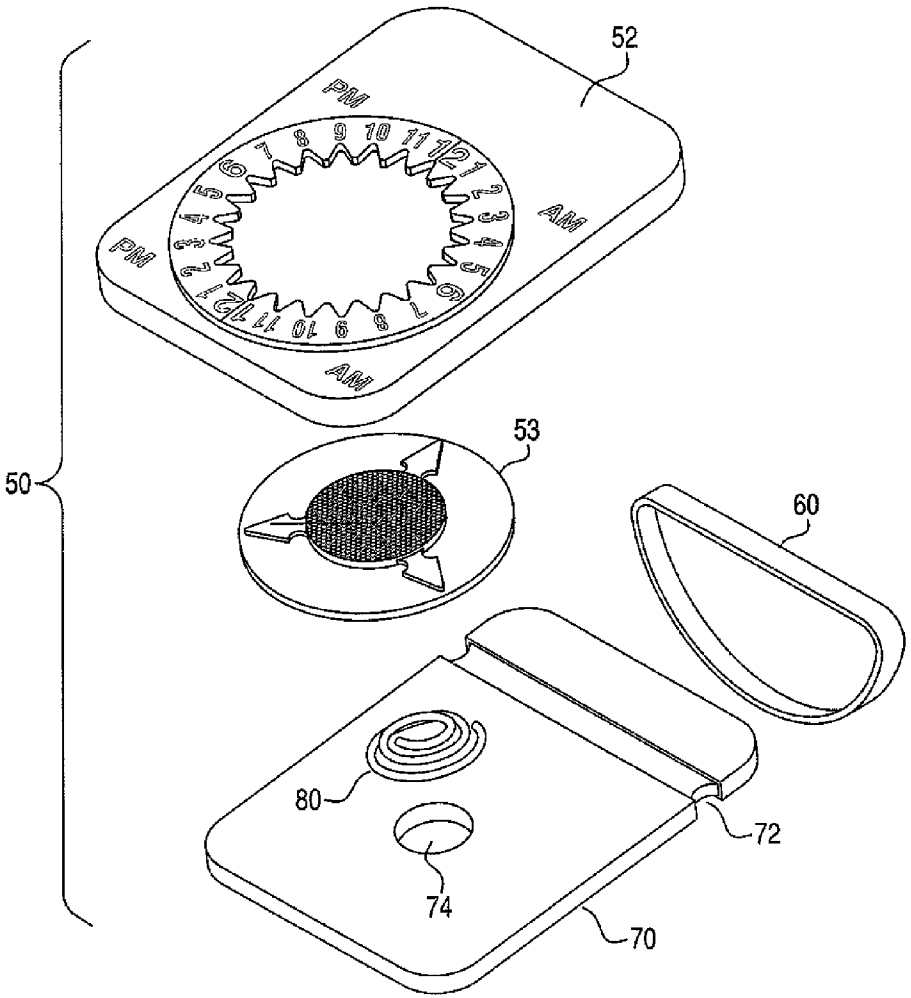
FIG. 11 is an exploded view of the embodiment shown in FIG. 8.
Figure 12:
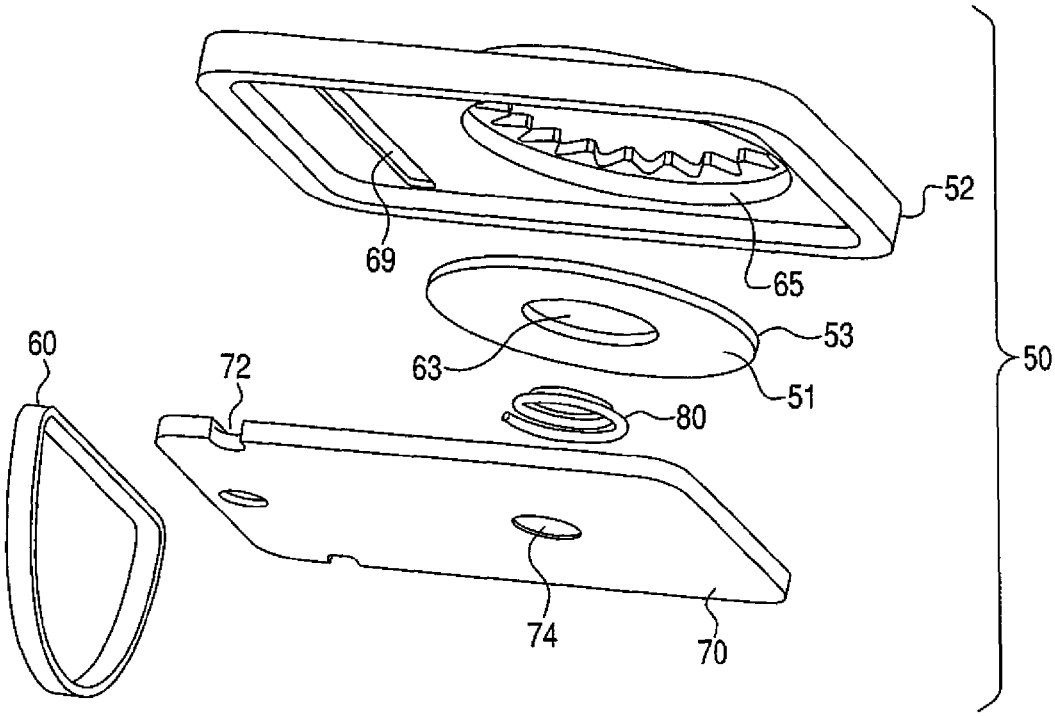
FIG. 12 is an alternative rearward exploded view of the embodiment shown in FIG. 8.
Figure 13:
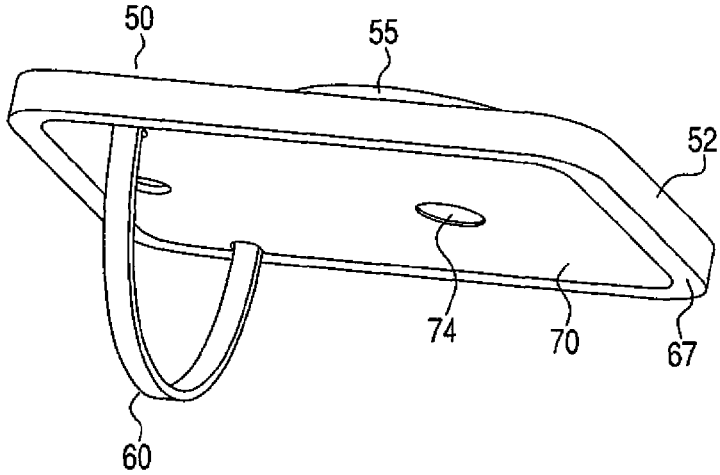
FIG. 13 is a rearward perspective view of the FIG. 8 embodiment.
Figure 14:
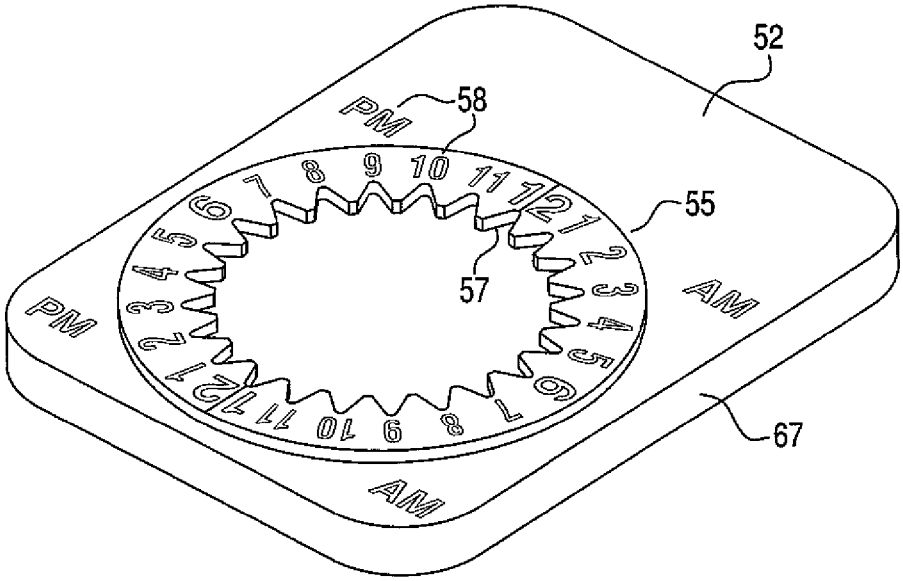
FIG. 14 is a front perspective view of the front housing of the FIG. 8 embodiment.
Figure 15:
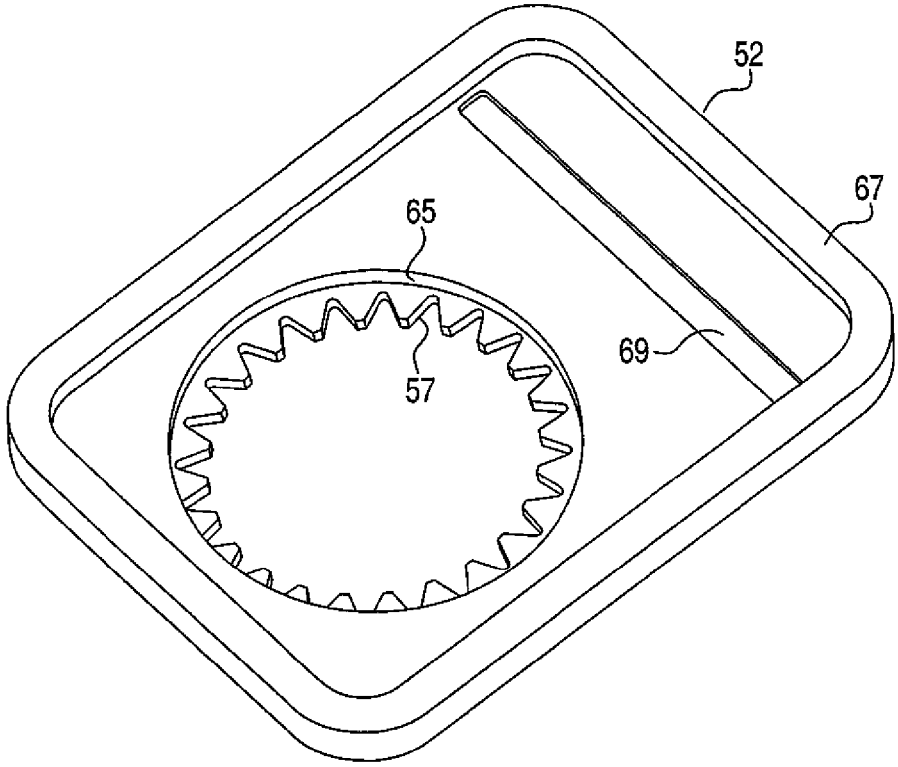
FIG. 15 is a rear perspective view of the front housing of the FIG. 8 embodiment.
Figure 16:
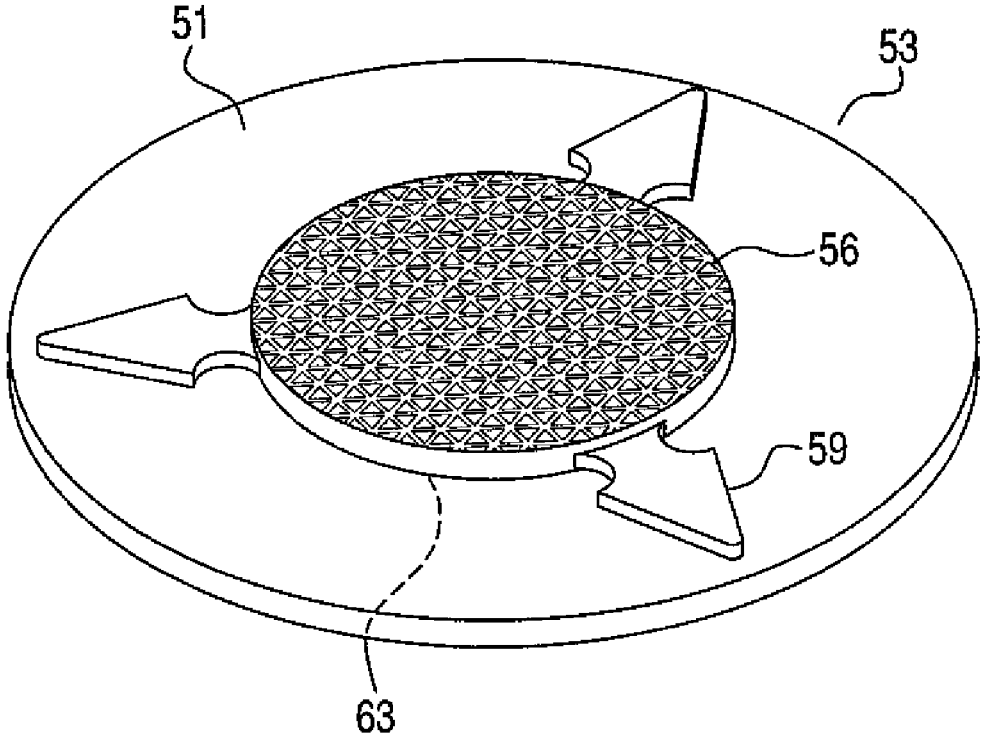
FIG. 16 is a separate perspective view of the central indicator element of the FIG. 8 embodiment.

FIGS. 11 and 12 show alternate exploded views of the cooperating elements of the invention embodiment 50. The respective front 52 and back 70 covers connect, to form the body or backing element of the device 50, by virtue of the insertion of the back cover 70 into a surrounding depending rim 67 associated with front cover 52. 52 and 70 can be retained one against the other by friction, glue, snap, etc. Two elements, namely the strap 60 and the resilient element 80 are trapped between the respective covers 52 and 70 once they are assembled. The flexible strap 60 is aligned in a groove or channel 72 and associated with the back cover 70. The front cover 52, likewise has a groove 69 to align and capture strap 60 on its rearward face once the back cover 70 is inserted therein.

The resilient element 80 is retained in an annular recess 63 on the rearward side of the rotating dial 53 main disk 51. The resilient element 80 pushes against back cover 70 and against the rearward side of the dial 53 in a position opposite the front side button 56. Hence, when a user pushes on the front side button 56, the entire dial retreats into the device 50 as resilient member 80 collapses against the rear cover 70. The axial alignment of the dial 53 within the overall device 50 is maintained owing to the close fitment between the sides 65 of the annular recess in the rearward side of the front cover 52 and the edges of dial 53 main disk element 51. The fitment between the main disk 51 and recess sides 65 enables aligned registered telescoping movement between the dial 53 and front cover 52 annular raised rim 55.

In use, a user would use a digit (thumb or finger) to depress dial 53 downwardly and into the body of the device 50 as defined by front cover 52 and rear cover 70. The side elements 65 cooperating with edges of main disk 51 retain the relative axial alignment of the recess sides 65 and edges of disk 51. The relative telescoping displacement between the dial 53 and front cover 52 enables the pointer protrusions 59 to slip beneath the downward extent of grooves 57 contained along the inner edge of raised annular rim 55. In this depressed and telescoped position, the dial 53 can be rotated so as to register the protrusions 59 with newly selected grooves indicating a new mediation cycle.

The resilient element 80 can be a spring washer, coil, or foam element. Or, in the alternative, the dial itself can be a spring washer (slightly concave) and incorporate the resilient function therein. The necessary feature is to enable registered telescoping movement into the body of the device to allow the pointers 59 to un-register with the grooves 57 and allow for dial rotation.

Although shown as a strap 60 for embodiment 50, the attaching function can be accomplished by an adhesive element in the same way as for the embodiment in FIG. 1-7.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A medication timing reminder device, comprising:

a backing element including a first and a second side, said first side including an attaching element to secure said device to an object, said second side having an annular ring element thereon, said annular ring including inwardly directed grooves having limited depth, said grooves defining inwardly facing surfaces;

a pin-wheel indicator dial including a central button for accepting pressure thereon to urge said dial to depress resiliently and telescopically toward said backing element and for rotating said dial about a central axis when so depressed, said indicator further including at least one radially outwardly directed raised indicator pointing element, said radially outwardly directed indicator pointing element engaging said inwardly facing surfaces of said inwardly directed grooves in said annular ring when said dial is not resiliently depressed into said backing element and disengaging from said grooves when resiliently depressed, wherein said inwardly directed surfaces face said central axis and provide positive locking surfaces when engaged with said radially outwardly directed indicator pointer element, and wherein said dial is resiliently urged into registration with said grooves by a separate resilient element.

2. A device as in claim 1, further wherein:

said backing element exceeds the size of said annular ring element so as to provide a printable space adjacent said annular ring.

3. A device as in claim 1, wherein:

said pin-wheel indicator dial is flexible plastic.

4. A device as in claim 1, wherein:

said inwardly directed grooves include grooves and accompanying indicia to match a predetermined medication cycle.

5. A device as in claim 1, wherein:

said pointing elements are color coded to indicate $1^{st}$ and $2^{nd}$ and subsequent doses over a medication time period.

6. A device as in claim 1, wherein:

said attaching element is a flexible strap.

7. A device as in claim 1, wherein:

said pin-wheel dial is available in a plurality of predetermined configurations reflecting incremented dosage intervals of 2 hour, 3 hour, 4 hour, 6 hour, 8 hour, and 12 hour and a corresponding number of pointing elements.

8. A medication timing reminder device, comprising:

a backing element;

an annular ring element disposed on said backing element, said annular ring including inwardly directed grooves defining inwardly facing surfaces;

an indicator dial for accepting pressure thereon to urge said dial toward said backing element and for rotating said dial about a central axis when so depressed, said indicator dial further including at least one radially outwardly directed pointing element facing away from said central axis, said radially outwardly directed indicator pointing element engaging said inwardly facing surfaces of said inwardly directed grooves in said annular ring when said dial is not depressed into said backing element, wherein said inwardly directed surfaces face said central axis and provide positive locking surfaces when engaged with said radially outwardly directed indicator pointer element, and wherein said dial is resiliently urged into registration with said grooves by a separate resilient element.

9. A device as in claim 8, further wherein:

said backing element exceeds the size of said annular ring element so as to provide a printable space adjacent said annular ring.

10. A device as in claim 8, wherein:

said indicator dial is flexible plastic.

11. A device as in claim 8, wherein:

said inwardly directed grooves include grooves and accompanying indicia to match a predetermined medication cycle.

12. A device as in claim 8, wherein:

said pointing elements are color coded to indicate $1^{st}$ and $2^{nd}$ and subsequent doses over a medication time period.

13. A device as in claim 8, further comprising an attaching element to secure said device to an object, wherein said attaching element is a flexible strap.

14. A device as in claim 8, wherein:

said indicator dial is available in a plurality of predetermined configurations reflecting incremented dosage intervals of 2 hour, 3 hour, 4 hour, 6 hour, 8 hour, and 12 hour and a corresponding number of pointing elements.

* * * * *